US005832641A

United States Patent [19]

Osterbrock et al.

[11] Patent Number: 5,832,641

[45] Date of Patent: Nov. 10, 1998

[54] WIRING DEVICE CIRCUIT IDENTIFICATION

[75] Inventors: James A. Osterbrock, Central Square; Michael R. Bryndzia, Baldwinsville, both of N.Y.

[73] Assignee: Pass & Seymour, Inc., Syracuse, N.Y.

[21] Appl. No.: 589,483

[22] Filed: Jan. 22, 1996

[51] Int. Cl.[6] ..... G09F 3/10

[52] U.S. Cl. ..... 40/299; 40/638; 174/66

[58] Field of Search ..... 40/299, 630, 638, 40/316; 174/66, 53, 56

[56] References Cited

U.S. PATENT DOCUMENTS

| | | | |
|---|---|---|---|
| 2,515,820 | 7/1950 | Clark | 40/725 X |
| 2,625,759 | 5/1953 | Koepke . | |
| 2,945,204 | 7/1960 | Berger | 40/316 X |
| 4,353,759 | 10/1982 | Stallings | 174/66 X |
| 4,479,317 | 10/1984 | Hanna . | |
| 4,565,023 | 1/1986 | Carlisle | 40/725 X |
| 4,780,573 | 10/1988 | Own | 174/66 |
| 4,800,239 | 1/1989 | Hill | 174/66 |

*Primary Examiner*—Brian K. Green
*Attorney, Agent, or Firm*—Bond, Schoeneck & King, LLP

[57] ABSTRACT

A wiring device such as a switch or receptacle includes a sheet suitable for receiving markings from a pencil or ball-point pen affixed to a predetermined surface area of the device. A conventional wall plate is secured to the device by a screw passing through coaxial openings in the wall plate, the sheet and the surface area of the device and secured in a threaded opening. In the disclosed embodiment, the device is a duplex receptacle with the surface area and sheet lying between the two plug-receiving portions. Indicia placed on the sheet by the installer indicates the specific circuit, i.e., the breaker and panel, in which the device is connected.

16 Claims, 2 Drawing Sheets

36
40
40'
38
34
26
28
PANEL BREAKER
20
16
22
24
16'
20'
18
12
14
10

WIRING DEVICE CIRCUIT IDENTIFICATION

BACKGROUND OF THE INVENTION

The present invention relates to methods and means for identifying a specific circuit, from a plurality of circuits in an electrical installation, in which a wiring device such as a switch or receptacle is connected.

It is the usual practise when installing electrical wiring in a structure to connect a limited number of wiring devices in a single circuit, thereby reducing the possibility of exceeding the rated circuit capacity by combined loads connected to the devices. Accordingly, fuse or breaker boxes have for many years been provided with a plurality of terminals for connecting wires from one or more wiring devices to the power source in separate circuits, each having a predetermined current capacity. When this capacity is exceeded, the fuse or breaker opens to remove the danger of fire or other hazards. Many installations include a plurality of boxes or so-called panels, each having a plurality of circuits with individual breakers.

When it is necessary to repair, replace, or otherwise work in proximity to exposed wiring of a wiring device, the circuit wherein the device is incorporated should be deenergized by opening the breaker, disconnecting the wiring device from the power source. Of course, it is not normally desirable to open all circuits in an entire installation when working on only one. However, it is not always easy to identify the specific circuit in which a particular wiring device is connected.

Efforts to address this problem appear in U.S. Pat. No. 2,625,759 and 4,479,317. In the former, a folded blank carrying a sliding member with circuit-identifying indicia is installed under the wall plate of a device to permit the slide to be moved in and out without removing the wall plate. In the latter, a separate, transparent plate having a panel for receiving identifying indicia is installed in surrounding relation to the device, between the wall plate and the wall. Other expedients commonly used by electricians include placing the identifying indicia on the inside of the wall plate with a felt-tipped pen or highlighting marker, which is defeated if wall plates are switched or replaced and not marked, or by placing engraved panels on the wall next to the device, which is more expensive and aesthetically unpleasing. The exterior surfaces of the wiring devices themselves are normally of smooth plastic, essentially incapable of receiving and retaining markings from conventional writing instruments such as pencils and ball point pens. Also, the devices may be of a dark color such that markings are not visually apparent.

It is a principal object of the present invention to provide improved, simple and inexpensive means and methods for readily and accurately identifying the specific circuit, from a plurality of such circuits, in which a wiring device is connected.

Another object is to provide an electrical wiring device having convenient circuit identifying means which does not require any mounting or installation items other than the device and compatible wall plate.

A further object is to provide circuit-identifying means for a wiring device which does not alter the manner of installation or the installed appearance of the device or its associated wall plate.

Still another object is to provide a method and means of placing circuit-identifying indicia upon a wiring device with a smooth, plastic exterior by means of a marking instrument, such as a pencil or ball point pen, likely to be carried by or readily available to an electrician or other installer of the device.

Other objects will in part be obvious and will in part appear hereinafter.

SUMMARY OF THE INVENTION

The invention is employed in a wiring device such as a switch or receptacle of a type which would normally be mounted in a junction box behind a wall opening. The device, as is commonly the case, includes base and/or cover portions of molded, high-impact plastic having smooth exterior surfaces which are unsuitable for receiving and retaining markings from common writing instruments. Although a felt-tipped marker, or the like, may apply visible markings on such surfaces, such markings do not adhere well and may be unintentionally wiped off or smudged and thereby rendered illegible.

The invention is disclosed in the context of a duplex wall receptacle having a pair of spaced, plug-receiving portions, and a plurality of wiring terminals for connecting the device in an electrical circuit. The device is mounted in the usual manner in a wall opening and a wall plate having apertures for exposing the plug-receiving portions is removably secured to the device by a screw passing through an opening in the wall plate and received in a threaded opening in the device, also in conventional fashion.

A sheet of paper or other material having a surface suitable for receiving and retaining markings from a pencil or ball point pen is adhesively secured on its other surface to a surface area of the device between the plug-receiving portions. The opening in the device for receiving the wall plate screw is also in this surface area, and an overlying opening is provided in the attached marking sheet. Thus, when the device and wall plate are installed, the sheet is held in place not only by the adhesive, but also by the wall plate screw. Circuit-identifying indicia may be placed upon the sheet at any time prior to installation of the wall plate.

The foregoing and other features and advantages of the invention will be more readily understood and fully appreciated from the following detailed description, taken in conjunction with the accompanying drawings.

DETAILED DESCRIPTION

Figure 1:
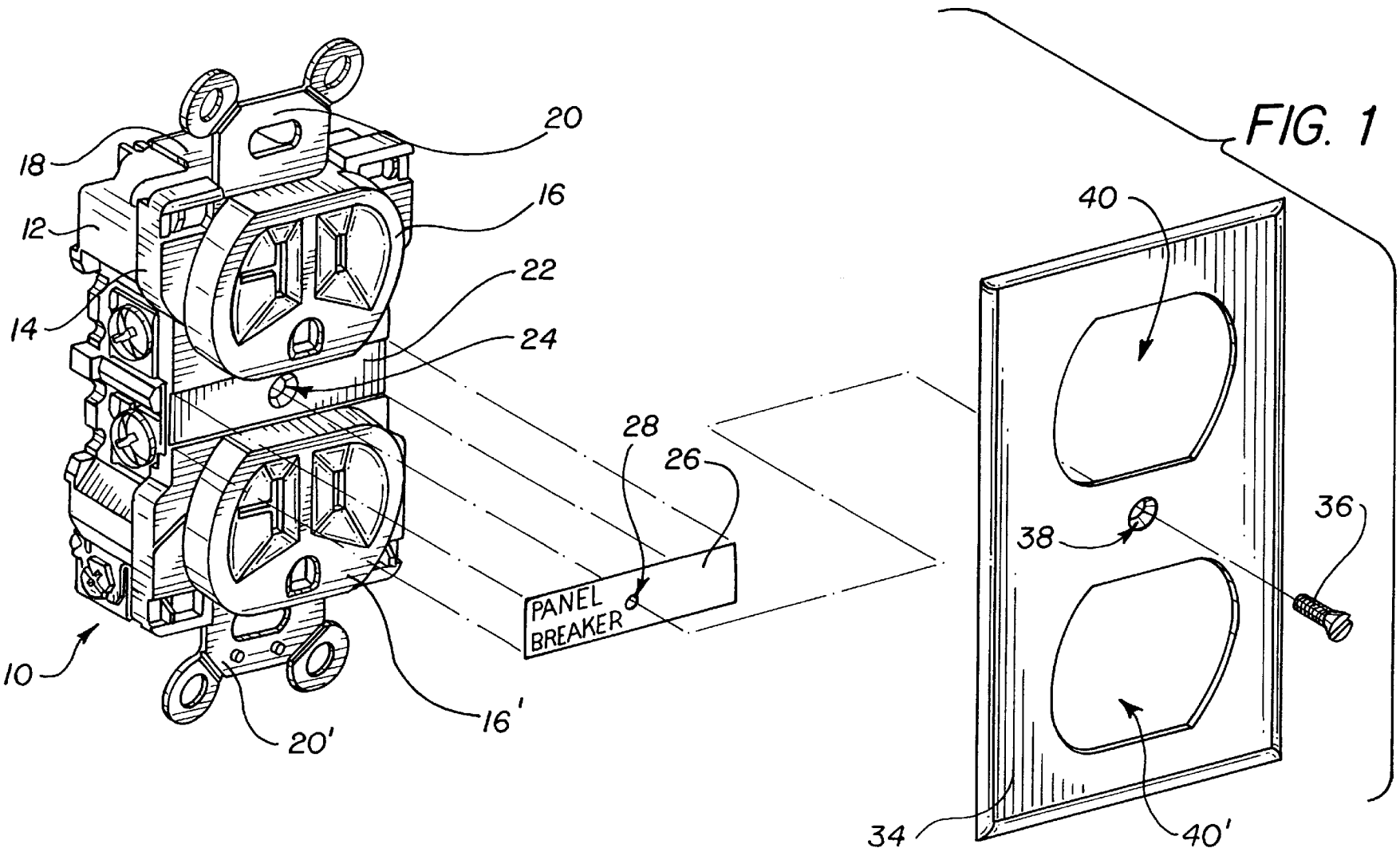
FIG. 1 is an exploded perspective view of the elements of the invention, including a duplex receptacle.

Referring now to the drawings, in FIG. 1 is shown a typical duplex wall receptacle 10, representative of the types of wiring devices wherein the present invention may be incorporated. Receptacle 10 includes base or body portion 12 and cover portion 14, both of molded plastic with smooth surfaces, essentially incapable of receiving and retaining markings from a pencil, ball point pen, or other such conventional writing implements. Cover 14 includes a pair of plug-receiving portions 16, 16' with appropriate apertures through which the blades of conventional plugs may be inserted for engagement by female electrical contacts (not shown) with base 12. Other elements of receptacle 10, including grounding strap 18, having the usual mounting ears 20, 20', are also conventional in nature and may be of any desired design.

Figure 2:
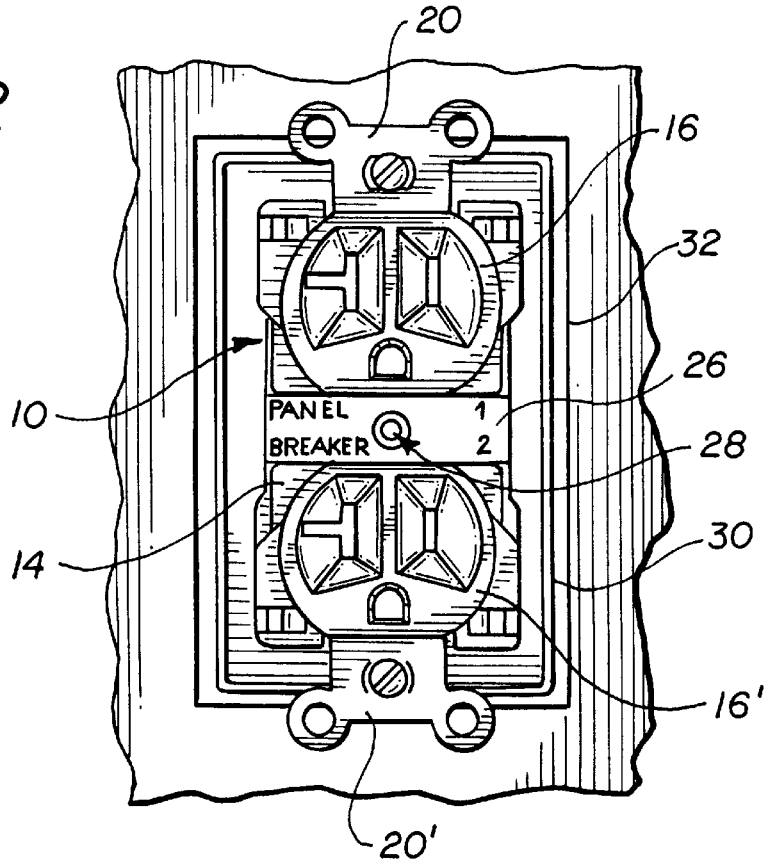
FIG. 2 is a front elevational view of the receptacle of FIG. 1, mounted in a junction box in a wall opening.

Plug-receiving portions 16, 16' are spaced from one another by surface area 22, extending laterally to the two side edges of cover 14 and preferably recessed along its upper and lower edges from the adjoining front surfaces of the cover. Opening 24 extends through the portion of cover 14 in surface area 22 and is substantially co-axial with an underlying, threaded opening in a portion of strap 18. Sheet 26, of paper or other material having a surface suited to receive and retain markings from a conventional writing instrument on the surface seen in FIGS. 1 and 2, is adhesively secured on its opposite surface to surface area 22 of receptacle 10. Preferably, the peripheral boundaries of surface area 22 and sheet 26 are substantially coextensive, and opening 28 in sheet 26 is aligned with opening 24 in cover 14.

After connection of hot and neutral wires between the appropriate terminals on device 10 and the open contacts of the circuit at the breaker panel, the device is installed in the usual manner in junction box 30 which is supported behind wall opening 32, as seen in FIG. 2. Appropriate numbers or other indicia, corresponding to assigned circuit and, when necessary, panel designations, are placed by the installer on sheet 26 either before or after installation of device 10 in box 30. Sheet 26 is preferably affixed to device 10 by the manufacturer, but may be supplied separately and affixed by the installer.

Figure 3:
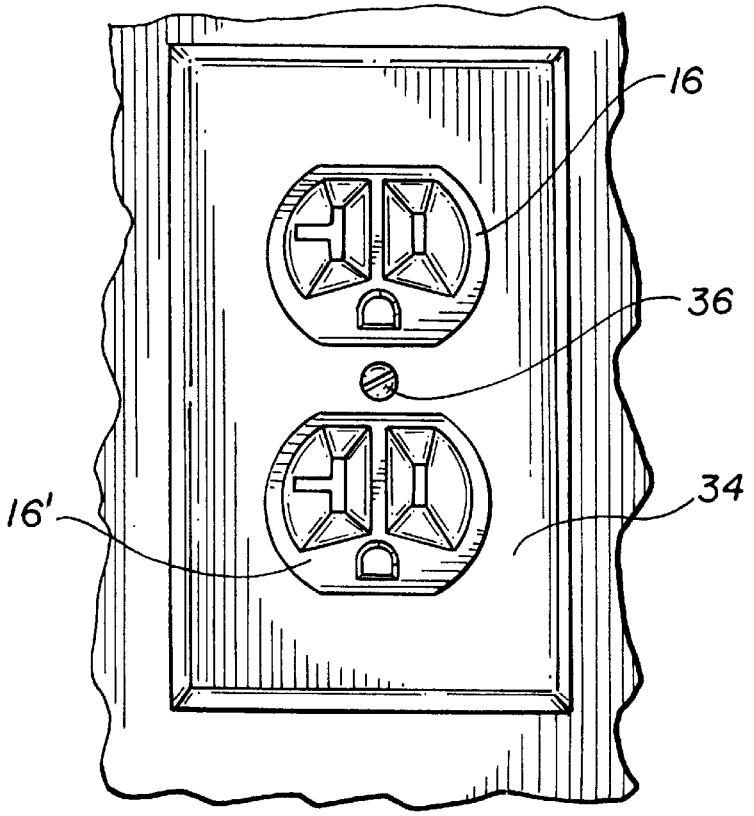
FIG. 3 is the same view as FIG. 2 after installation of a wall plate.

Subsequent to installing device 10 in box 30 and placing the indicia on sheet 26, wall plate 34 is installed in covering relation to wall opening 32 by means of screw 36 which extends through opening 38 in the wall plate, openings 28 and 24 in sheet 26 and cover 14, respectively, and is received in the threaded opening of device 10. Plug-receiving portions 16, 16' are exposed through openings 40, 40', respectively, in wall plate 34, as seen in FIG. 3. Both the manner of installation and the appearance after installation of the device and wall plate are the same as if the present invention were not employed. Since it is necessary to remove the wall plate before performing any operations on device 10 or its associated wiring after initial installation, the specific circuit breaker and box or panel to which device 10 is connected will be immediately apparent.

What is claimed is:

1. A duplex receptacle for installation in a wall opening and connection into one of a plurality of electrical circuits, said duplex receptacle comprising:

(a) a cover made substantially from plastic, the cover having a pair of plug receiving portions, the plug receiving portions having apertures sized for receiving blades of conventional plugs, the pair of plug receiving portions spaced from one another by a smooth surface area in the cover, the smooth surface area defined by a first, peripheral boundary lying between said plug receiving portions and extending laterally to two side edges of the cover, said surface area being essentially incapable of receiving and retaining visible markings from a conventional pen or pencil; and (b) a sheet of material having a second, peripheral boundary substantially coextensive with the first peripheral boundary, a first surface secured in covering relation to at least a portion of said surface area, and a second surface capable of receiving and retaining visible markings from a conventional pen or pencil.

2. The duplex receptacle according to claim 1 wherein said first surface is adhesively secured to said surface area.

3. The duplex receptacle according to claim 1 further comprising a threaded aperture adapted to receive a screw for securing a wall plate to said duplex receptacle.

4. The duplex receptacle according to claim 3 wherein said surface area includes an opening coaxial with said threaded aperture.

5. The duplex receptacle according to claim 4 wherein said sheet of material includes an opening substantially the same size as and coaxial with the opening in said surface area.

6. The duplex receptacle according to claim 1 further comprising a wall plate wherein said surface area is obscured by said wall plate.

7. The duplex receptacle according to claim 6 wherein said wall plate is non-transparent.

8. A wiring device for installation in a wall opening and connection into one of a plurality of electrical circuits, said device comprising:

a) a plastic member having a pair of plug receiving portions, the plug receiving portions having apertures sized for receiving blades of conventional plugs, the pair of plus receiving portions spaced from one another by a smooth surface area in the plastic member, the smooth surface area defined by a first, peripheral boundary lying between said plug receiving portions and extending laterally to two side edges of the plastic member, said surface area being essentially incapable of receiving and retaining visible markings from a conventional pen or pencil; and b) a sheet of material having a second, peripheral boundary, a first surface secured in covering relation to at least a portion of said surface area, and a second surface capable of receiving and retaining visible markings from a conventional pen or pencil, wherein said first surface is adhesively secured to said surface area, said second, peripheral boundary lying within said first, peripheral boundary.

9. The wiring device of claim 8 wherein said first and second boundaries are substantially coextensive.

10. The wiring device of claim 9 wherein said surface area includes an opening coaxially aligned with a threaded aperture in said wiring device adapted to receive a screw for securing a wall plate to said wiring device and wherein said sheet of material includes an opening coaxial with the opening of said surface area.

11. The wiring device of claim 8 further comprising a wall plate, wherein said wall plate is non-transparent.

12. A wiring device for installation in a wall opening and connection into one of a plurality of electrical circuits, said device comprising:

a) a plastic member having a pair of plug receiving portions, the plug receiving portions having apertures sized for receiving blades of conventional plugs, the pair of plug receiving portions spaced from one another by a smooth surface area in the plastic member, the smooth surface area defined by a first, peripheral boundary lying between said plug receiving portions and extending laterally to two side edges of said plastic member, said surface area being essentially incapable of receiving and retaining visible markings from a conventional pen or pencil;

b) a sheet of material having a second, peripheral boundary, a first surface secured in covering relation to at least a portion of said surface area, and a second surface capable of receiving and retaining visible markings from a conventional pen or pencil, said second, peripheral boundary of said sheet of material being located within the first, peripheral boundary; and, further comprising a wall plate in combination with said wiring device, wherein said wall plate is non-transparent.

13. The wiring device of claim 12 wherein said first and second boundaries are substantially coextensive.

14. The wiring device of claim 12 wherein said first surface is adhesively secured to said surface area.

15. The wiring device of claim 12 wherein said surface area includes an opening coaxially aligned with a threaded aperture in said wiring device adapted to receive a screw for securing said wall plate to said wiring device and wherein said sheet of material includes an opening coaxial with the opening of said surface area.

16. The wiring device of claim 15 wherein said first surface is adhesively secured to said surface area.

* * * * *